US010829993B1

(12) United States Patent
von Gynz-Rekowski et al.

(10) Patent No.: US 10,829,993 B1
(45) Date of Patent: Nov. 10, 2020

(54) WEAR RESISTANT VIBRATION ASSEMBLY AND METHOD

(71) Applicant: Rival Downhole Tools LC, Houston, TX (US)

(72) Inventors: Gunther H H von Gynz-Rekowski, Montgomery, TX (US); William Christian Herben, Magnolia, TX (US); Steven Samuel Mitchell, Scottsdale, AZ (US); Russell Wayne Koenig, Conroe, TX (US); Mark Joshua Miller, Valencia, PA (US); Kevin James Rudy, Houston, TX (US)

(73) Assignee: RIVAL DOWNHOLE TOOLS LC, Houston, TX (US)

( * ) Notice: Subject to any disclaimer, the term of this patent is extended or adjusted under 35 U.S.C. 154(b) by 75 days.

(21) Appl. No.: 16/401,594

(22) Filed: May 2, 2019

(51) Int. Cl.

| | |
|---|---|
| ***E21B 4/02*** | (2006.01) |
| ***E21B 21/10*** | (2006.01) |
| ***E21B 17/10*** | (2006.01) |
| ***E21B 28/00*** | (2006.01) |

(52) U.S. Cl.
CPC ..... *E21B 4/02* (2013.01); *E21B 17/1085* (2013.01); *E21B 21/10* (2013.01); *E21B 28/00* (2013.01)

(58) Field of Classification Search
CPC ..... E21B 47/24; E21B 4/02; E21B 7/24
See application file for complete search history.

(56) References Cited

U.S. PATENT DOCUMENTS

| | | | | |
|---|---|---|---|---|
| 2,780,438 | A | 2/1957 | Bielstein | |
| 4,220,380 | A * | 9/1980 | Crase | E21B 4/003 175/107 |
| 4,819,745 | A * | 4/1989 | Walter | E21B 7/18 175/107 |
| 5,817,937 | A * | 10/1998 | Beshoory | E21B 47/017 73/152.46 |

(Continued)

FOREIGN PATENT DOCUMENTS

| | | |
|---|---|---|
| AU | 2014902054 | 5/2014 |
| CN | 203403820 | 1/2014 |
| WO | 2016063131 | 4/2016 |

OTHER PUBLICATIONS

Impulse Downhole Tools, "Actipulse" brochure.

(Continued)

*Primary Examiner* — Shane Bomar
(74) *Attorney, Agent, or Firm* — Jones Walker LLP

(57) ABSTRACT

A vibration assembly includes a valve above a rotor and stator. The rotor rotates within the stator as fluid flows therethrough. The valve includes a rotating valve segment, which rotates with the rotor, and a non-rotating valve segment each including at least one fluid passage. In an open position, the fluid passages of the valve segments are aligned and a fluid flows through the valve. In a restricted position, the fluid passages of the valve segments are partially or completely unaligned, thereby creating a pressure pulse that is transmitted through the drill string or coiled tubing above the valve. The valve may further include an inner sleeve and an outer sleeve surrounding the non-rotating valve segment. The inner and outer sleeves allow axial sliding but prevent rotation of the non-rotating valve segment. The assembly may further include a lower thrust bearing at a lower end of the rotor.

21 Claims, 10 Drawing Sheets

(56) References Cited

U.S. PATENT DOCUMENTS

| | | | | |
|---|---|---|---|---|
| 6,279,670 | B1 | 8/2001 | Eddison et al. | |
| 7,405,998 | B2 | 7/2008 | Webb et al. | |
| 8,162,078 | B2 | 8/2012 | Anderson | |
| 8,474,548 | B1 * | 7/2013 | Young | E21B 47/24 175/40 |
| 9,091,123 | B2 | 7/2015 | Gust | |
| 9,273,529 | B2 | 3/2016 | Eddison et al. | |
| 9,637,976 | B2 | 5/2017 | Lorenson et al. | |
| 9,657,561 | B1 | 5/2017 | Bargach et al. | |
| 9,765,584 | B2 | 9/2017 | Lorenson et al. | |
| 10,677,006 | B2 * | 6/2020 | von Gynz-Rekowski | E21B 7/24 |
| 2001/0054515 | A1 | 12/2001 | Eddison et al. | |
| 2007/0056771 | A1 * | 3/2007 | Gopalan | E21B 47/24 175/40 |
| 2009/0223676 | A1 | 9/2009 | Eddison et al. | |
| 2011/0073374 | A1 | 3/2011 | Bunney et al. | |
| 2011/0217199 | A1 | 9/2011 | Groves | |
| 2012/0279724 | A1 | 11/2012 | Eddison et al. | |
| 2013/0048386 | A1 | 2/2013 | Le et al. | |
| 2014/0014413 | A1 | 1/2014 | Niina et al. | |
| 2014/0041943 | A1 | 2/2014 | Lanning et al. | |
| 2014/0190749 | A1 | 7/2014 | Lorenson et al. | |
| 2014/0196905 | A1 | 7/2014 | Schultz et al. | |
| 2014/0246240 | A1 | 9/2014 | Lorenson et al. | |
| 2015/0075867 | A1 | 3/2015 | Eddison et al. | |
| 2015/0285067 | A1 * | 10/2015 | Logan | E21B 21/08 175/317 |
| 2016/0251920 | A1 | 9/2016 | Galley et al. | |
| 2017/0016289 | A1 | 1/2017 | Gillis | |
| 2017/0204693 | A1 | 7/2017 | von Gynz-Rekowski et al. | |
| 2017/0356289 | A1 * | 12/2017 | Baudoin | E21B 47/095 |
| 2018/0030813 | A1 * | 2/2018 | Smith | E21B 34/10 |
| 2018/0066513 | A1 * | 3/2018 | Sugiura | E21B 47/01 |
| 2020/0149367 | A1 * | 5/2020 | Doster | E21B 34/10 |

OTHER PUBLICATIONS

Trican Completion Solutions, Toe Tapper™ brochure.

Applicant's co-pending U.S. Appl. No. 15/816,281, "Vibration Assembly and Method", filed Nov. 17, 2017.

International Search Report and Written Opinion dated May 7, 2020, from Applicant's counterpart International Patent Application No. PCT/US2020/18070.

* cited by examiner

WEAR RESISTANT VIBRATION ASSEMBLY AND METHOD

BACKGROUND OF THE INVENTION

In the drilling of oil and gas wells, a downhole drilling motor and a drill bit are attached to the end of a drill string. Most downhole drilling motors include a rotor rotating within a stator. The rotation of the rotor provides a vibration to the adjacent drill bit as it cuts through the subterranean formation to drill the wellbore. The drill string slides through the higher portions of the wellbore as the drill bit at the end of the drill string extends the wellbore deeper into the formation. A vibration tool is sometimes attached to the drill string a distance above the drill bit (e.g., 800-1,500 feet above the drill bit). The vibration tool provides vibration to the portions of the drill string above the vibration tool, thereby facilitating the movement of the drill string through the wellbore.

Conventional vibration tools include a power section made of a rotor rotating within a stator and a valve positioned below the rotor. As the rotor rotates, the valve periodically restricts fluid flow through the vibration tool, which creates a pressure pulse or waterhammer that is transmitted through the power section and up through the portion of the drill string above the vibration tool.

DETAILED DESCRIPTION OF THE PREFERRED EMBODIMENTS

A vibration assembly of the present disclosure may be attached to a drill string and lowered into a wellbore. The vibration assembly may include a valve positioned above a power section. The power section may be a positive displacement power section, a turbine, or any other hydraulic motor mechanism for generating torque with a fluid flow. In one embodiment, the power section is a positive displacement power section including a rotor disposed at least partially within a stator. The rotor is configured to rotate within the stator as a fluid flows through the vibration assembly. The valve may include a rotating valve segment and a stationary valve segment each including at least one fluid passage. The rotating valve segment is configured to rotate with rotation of the rotor, while the stationary valve segment remains fixed (i.e., does not rotate). In an open position, the fluid passage of the rotating valve segment is aligned with the fluid passage of the stationary valve segment, and the fluid flows through these fluid passages of the valve. In a restricted position, the fluid passage of the rotating valve segment is not aligned with a fluid passage in the stationary valve segment (e.g., at least partially unaligned), thereby temporarily restricting the fluid flow through the valve. The flow restriction creates a pressure pulse or waterhammer that is transmitted upstream thereby stretching and retracting a drill string or coiled tubing line above the vibration assembly. Because the valve is positioned above the power section, the vibration assembly of the present disclosure transmits a pressure pulse to the drill string above more efficiently than conventional vibration tools. In certain embodiments, the vibration assembly may also include a shock assembly disposed at an upper end of the vibration assembly. When present, the shock assembly facilitates relative axial movement of the drill string above the vibration assembly relative to the drill string below the vibration assembly thereby vibrating the drill string above the vibration assembly.

In some embodiments, a flex shaft or stiff cable may interconnect the valve and the power section. An upper end of the flex shaft or cable may be attached to the rotating valve segment, and a lower end of the flex shaft or cable may be attached to the rotor. In this way, the flex shaft or cable transmits torque from the rotor to the rotating valve segment to rotate the rotating valve segment with the rotation of the rotor.

Figure 1A:
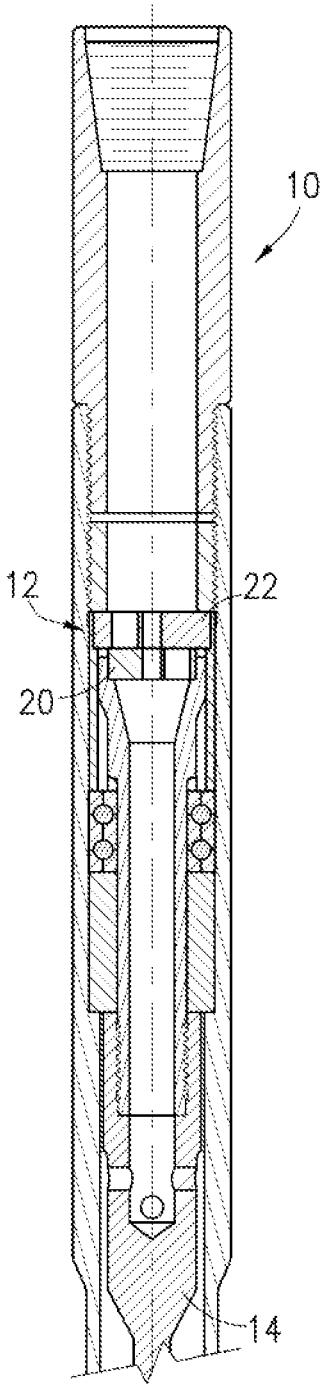
FIGS. 1A-1B are a cross-sectional view of a vibration assembly.
Figure 1B:
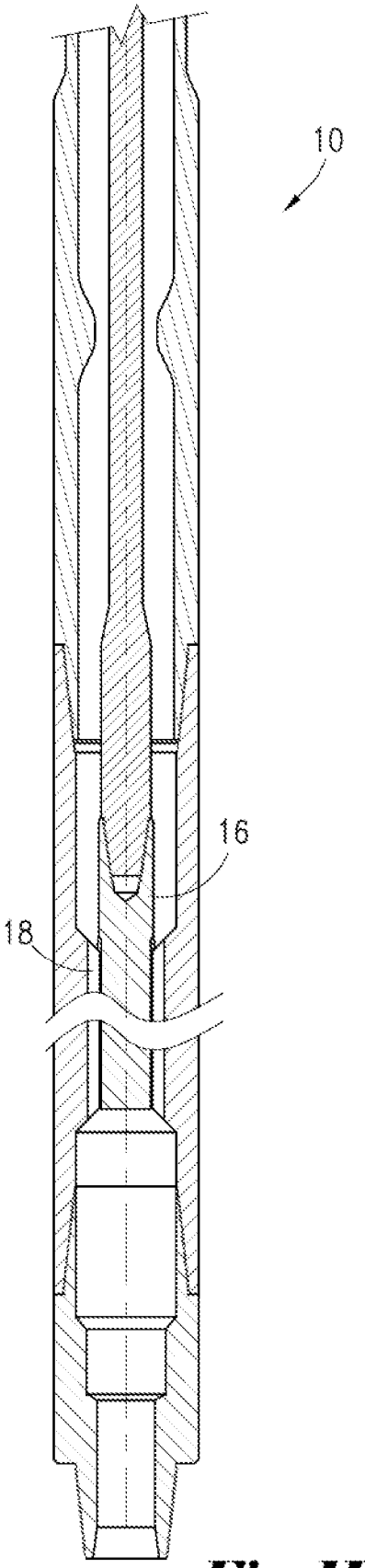

FIGS. 1A-1B illustrate one embodiment of the vibration assembly of the present disclosure. Vibration assembly 10 includes valve 12, flex shaft 14 attached to a lower end of valve 12, rotor 16 attached to a lower end of flex shaft 14, and stator 18 disposed at least partially around rotor 16. Valve 12 includes rotating valve segment 20 and stationary valve segment 22. In this embodiment, rotating valve segment 20 is positioned below stationary valve segment 22, but other embodiments may include rotating valve segment 20 positioned above stationary valve segment 22. Vibration assembly 10 may also include one or more tubular housing segments having an inner bore, with valve 12, flex shaft 14, rotor 16, and stator 18 disposed within the inner bore.

Figure 3:
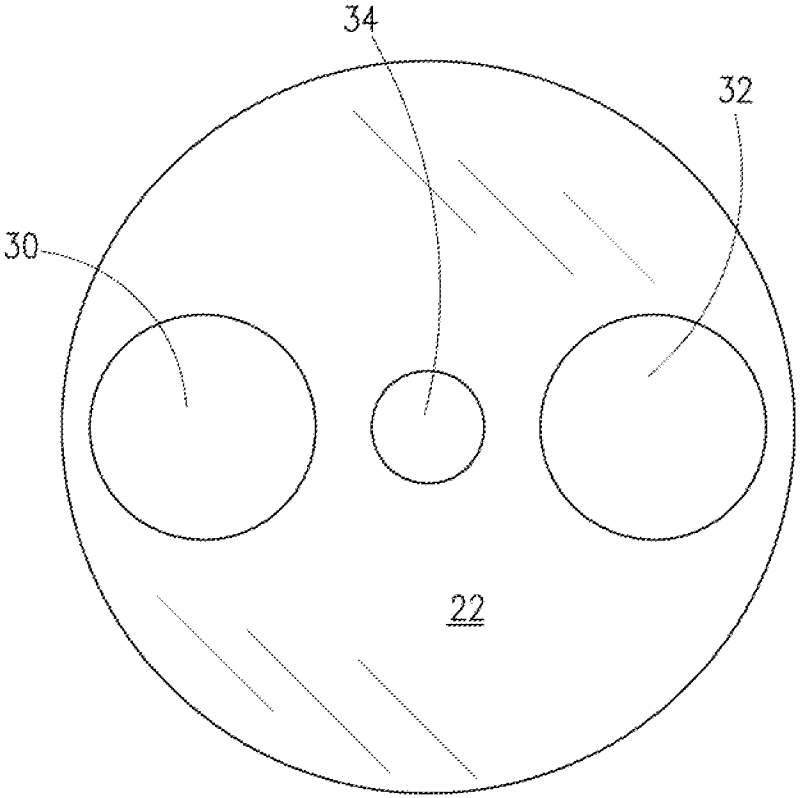
FIG. 3 is a top view of a stationary valve segment of the vibration assembly.
Figure 2:
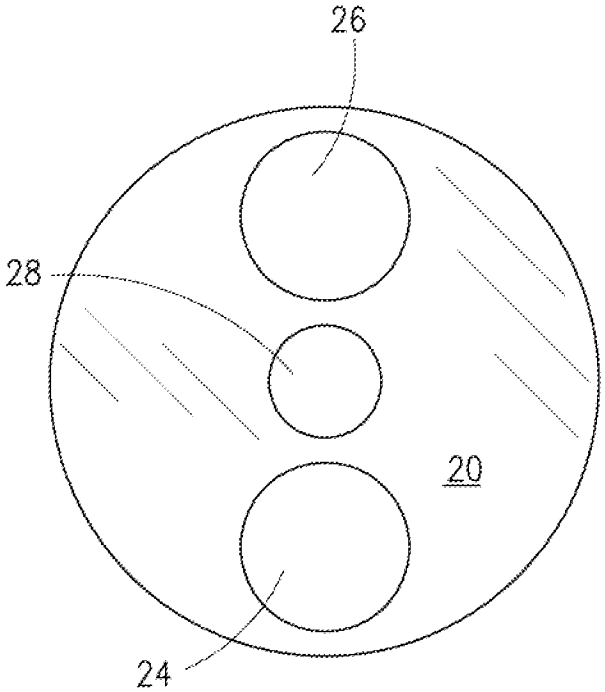
FIG. 2 is a top view of a rotating valve segment of the vibration assembly.

With reference to FIGS. 2 and 3, rotating valve segment 20 may be formed of a plate or disc including fluid passages 24 and 26 and central passage 28. Stationary valve segment 22 may be formed of a plate or disc including fluid passages 30 and 32 and central passage 34. In an open position, passages 24, 26 of rotating valve segment 20 are at least partially aligned with passages 30, 32 of stationary valve segment 22 to allow a fluid to flow through valve 12. The fluid flow may be temporarily restricted when passages 24, 26 of rotating valve segment 20 are not aligned with passages 30, 32 of stationary valve segment 22. In this restricted position, the fluid flows through central passages 28, 34 of rotating valve segment 20 and stationary valve segment 22, respectively, to guarantee a minimum fluid flow to drive rotor 16 in stator 18.

In other embodiments, rotating and stationary valve segments 20, 22 include no central passages. Instead, the fluid passages of valve segments 20, 22 are arranged such that at least one fluid passage of rotating valve segment 20 is partially aligned with a fluid passage of stationary valve segment 22 in the restricted position to guarantee a minimum fluid flow to drive rotor 16 in stator 18.

Figure 4A:
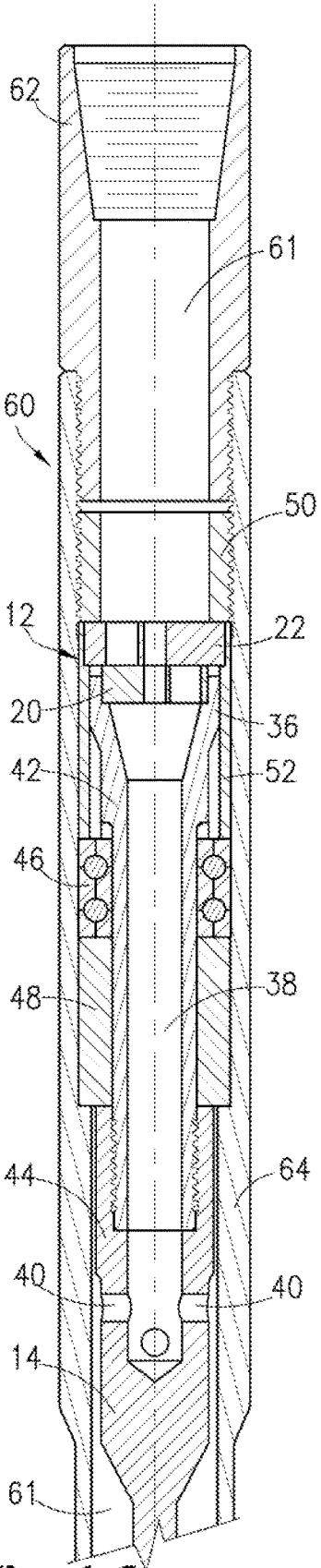
FIGS. 4A-4C are another cross-sectional view of the vibration assembly.
Figure 4B:
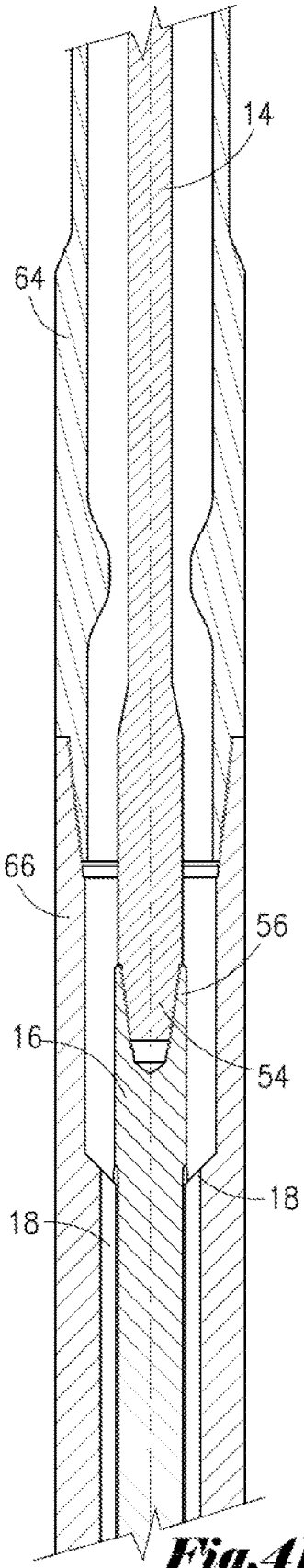
Figure 4C:
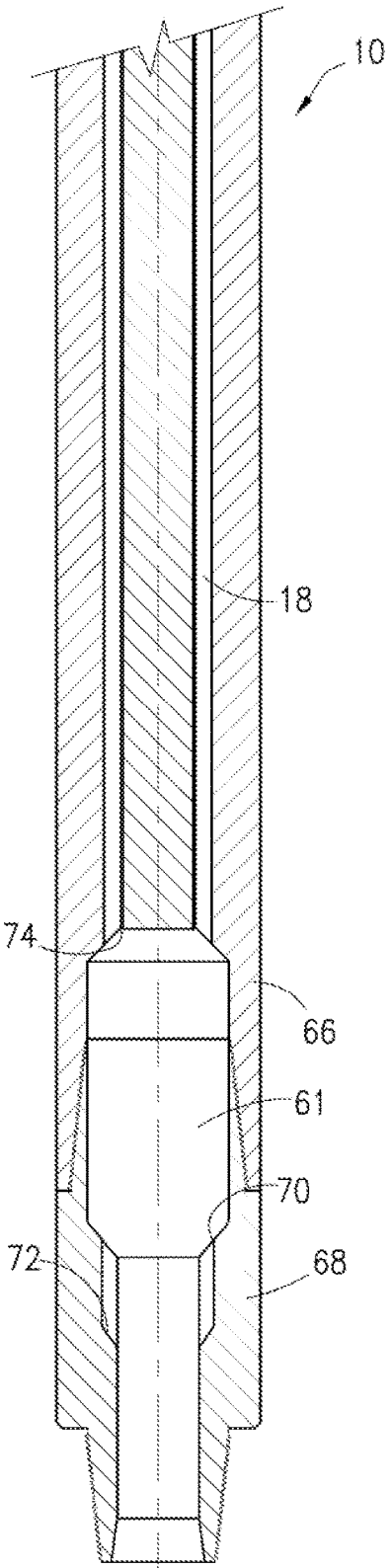
Figure 5A:
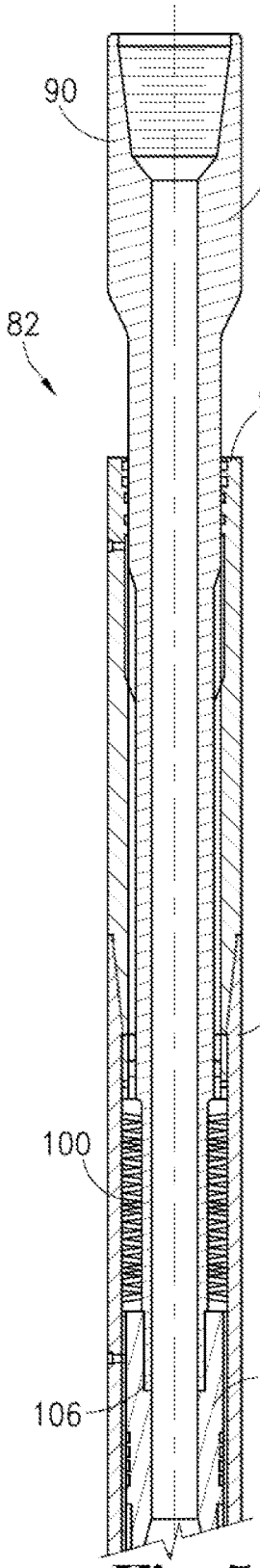
FIGS. 5A-5D are a cross-sectional view of the vibration assembly including a shock assembly.
Figure 5B:
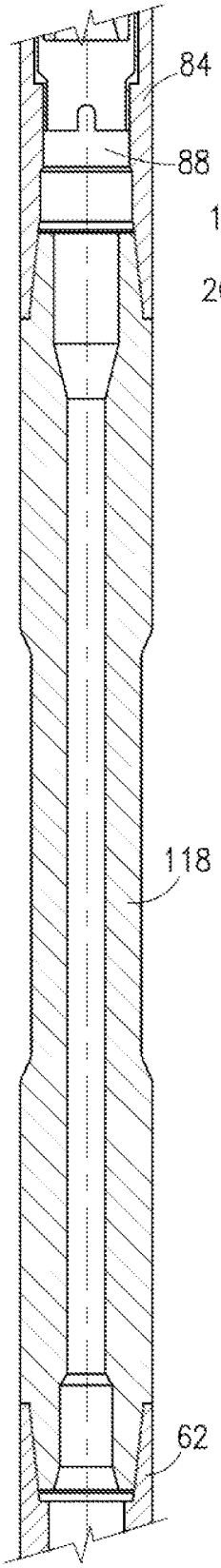
Figure 5C:
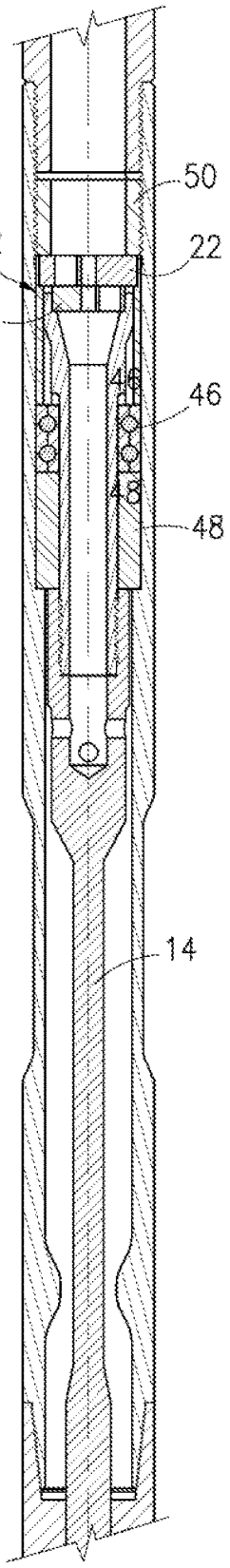
Figure 5D:
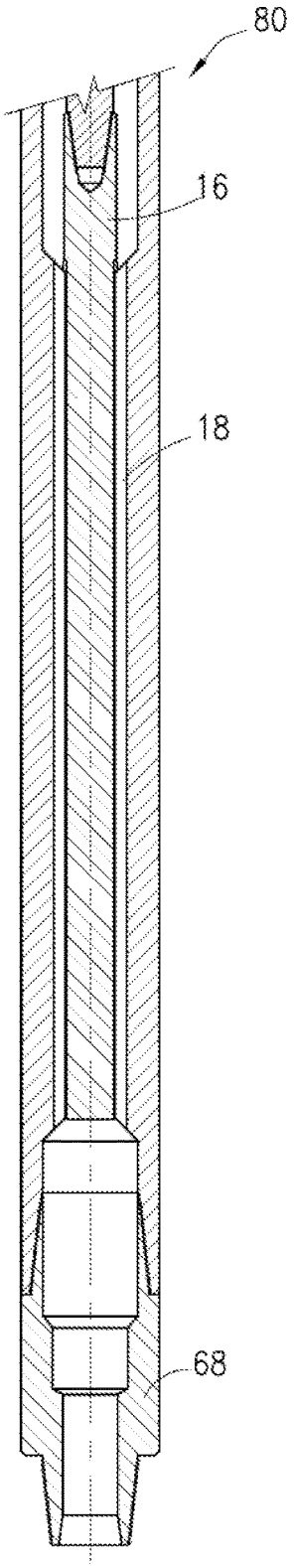

Referring now to FIGS. 4A-4C, rotating valve segment 20 is secured to upper end 36 of flex shaft 14 such that rotating valve segment 20 rotates with flex shaft 14. Central bore 38 of flex shaft 14 extends from upper end 36 to fluid passages 40. Flex shaft 14 may include any number of fluid passages 40 to support the fluid flow through central bore 38. The upper portion of flex shaft 14 surrounding central bore 38 may be formed of two or more segments, such as segments 42, 44. Thrust bearings 46 and radial bearings 48 may be disposed around segment 42, and radial bearings 48 may abut an upper end of segment 44. Stationary valve segment 22 is disposed between rotating valve segment 20 and nut 50. Compression sleeve 52 may be disposed around stationary valve segment 22 and segment 42 of the upper portion of flex shaft 14. An upper end of compression sleeve 52 may abut a lower end of nut 50. Stationary valve segment 22 may be maintained in a non-rotating and stationary position by nut 50. Radial bearings 48 may be maintained by compression sleeve 52 and nut 50. Below fluid passages 40, flex shaft 14 may be formed of a rod or bar of sufficient length to provide flexibility for offsetting the eccentric motion of a multi-lobe rotor. Lower end 54 of flex shaft 14 may be secured to upper end 56 of rotor 16. In one embodiment, flex shaft 14 and rotor 16 may be threadedly connected. In this way, rotor 16 is suspended within stator 18 by flex shaft 14.

Housing 60 may include inner bore 61. Housing 60 may be formed of housing segments 62, 64, 66, and 68, each including an inner bore. Nut 50 may be threadedly connected to the inner bore of housing segment 64. Radial bearings 48 may engage a shoulder of housing segment 64 to support thrust bearings 46, compression sleeve 52, and stationary valve segment 22, thereby operatively suspending flex shaft 14 and rotor 16 within inner bore 61 of housing 60. Stator 18 may be secured within the inner bore of housing segment 66. Housing segment 68 may include safety shoulder 70 designed to catch rotor 16 if rotor 16 is disconnected from flex shaft 14 or if flex shaft 14 is disconnected from housing segment 64. Housing segment 68 may further include fluid bypass 72 to allow a fluid flow through inner bore 61 if rotor 16 engages safety shoulder 70.

Referring still to FIGS. 4A-4C, vibration assembly 10 may be secured within a drill string by threadedly connecting housing segment 62 to a first drill string segment and connecting housing segment 68 to a second drill string segment. A fluid may be pumped through an inner bore of the first drill string segment and into inner bore 61 of housing 60. With valve 12 in the open position, the fluid may flow through fluid passages 30, 32 of stationary valve segment 22 and fluid passages 24, 26 of rotating valve segment 20. The fluid flow may continue into central bore 38 of flex shaft 14 and out through fluid passages 40 of flex shaft 14 to return to inner bore 61 of housing 60. The fluid may flow around flex shaft 14 in inner bore 61 of housing 60 and around upper end 56 of rotor 16. Rotor 16 includes a number of lobes that correlate with a certain number of cavities of stator 18. When the fluid reaches stator 18, the fluid flows through the cavities between stator 18 and rotor 16. This fluid flow causes rotor 16 to rotate within stator 18. In this way, rotor 16 and stator 18 form a positive displacement power section. The fluid flow exits at lower end 74 of stator 18 to return to inner bore 61 of housing 60 and continue flowing into an inner bore of the second drill string segment below vibration assembly 10.

As the fluid flow through stator 18 rotates rotor 16, flex shaft 14 and rotating valve segment 20 are rotated as torque is transmitted to these elements. Rotating valve segment 20 rotates relative to stationary valve segment 22, which cycles valve 12 between the open position and the restricted position in which fluid flow is limited to central passages 28, 34 of rotating and stationary valve segments 20, 22. The fluid flow restriction generates a pressure pulse or water-hammer that is transmitted upstream to the drill string above vibration assembly 10. The repeated pressure pulse generation causes a stretching and retracting in the drill string above vibration assembly 10, thereby facilitating vibration and easing the movement of the drill string through a wellbore. The vibration may reduce friction between an outer surface of the drill string and an inner surface of the wellbore.

In an alternate embodiment, the power section is formed of a turbine or any other hydraulic motor mechanism for generating torque with a fluid flow. The power section includes at least one rotor element configured to rotate with the fluid flow through the power section. The rotor element is operatively connected to the rotating valve segment, such that the rotating valve segment rotates with a rotation of the rotor.

FIGS. 5A-5D illustrate another alternate embodiment of the vibration assembly of the present disclosure. Vibration assembly 80 includes the same features described above in connection with vibration assembly 10, with the same reference numbers indicating the same structure and function described above. Vibration assembly 80 further includes an integrally formed shock assembly 82 designed to facilitate axial movement in the adjacent drill string with the pressure pulse transmitted by vibration assembly 80. In other embodiments, a separate shock assembly may be placed above the vibration assembly. In still other embodiments (as illustrated in FIGS. 1A-4C), the vibration assembly may function without a shock assembly, such as applications in which the vibration assembly is used with coiled tubing.

In the embodiment illustrated in FIGS. 5A-5D, shock assembly 82 may include first sub 84 and mandrel 86 at least partially slidingly disposed within inner bore 88 of first sub 84. Upper end 90 of mandrel 86 extends above upper end 92 of first sub 84. Shock assembly 82 may also include piston 98 and spring 100. Piston 98 may be threadedly secured to lower end 106 of mandrel 86. Spring 100 is disposed around mandrel 86 and within inner bore 88 of first sub 84. Spring 100 is configured to be compressed with axial movement of mandrel 86 relative to first sub 84 in both directions. Shock assembly 82 may further include flex sub 118. A lower end of flex sub 118 may be secured to the upper end of housing segment 62 above valve 12. In this way, shock assembly 82 is disposed above housing 60. An upper end of flex sub 118 may be secured to a lower end of first sub 84 of shock assembly 82. An upper end 90 of mandrel 86 of shock assembly 82 may be secured to a drill string segment to position vibration assembly 80 in the drill string. A pressure pulse generated by valve 12 may cause mandrel 86 to move relative to first sub 84 in two directions along an axis (i.e., in both axial directions).

Figure 6A:
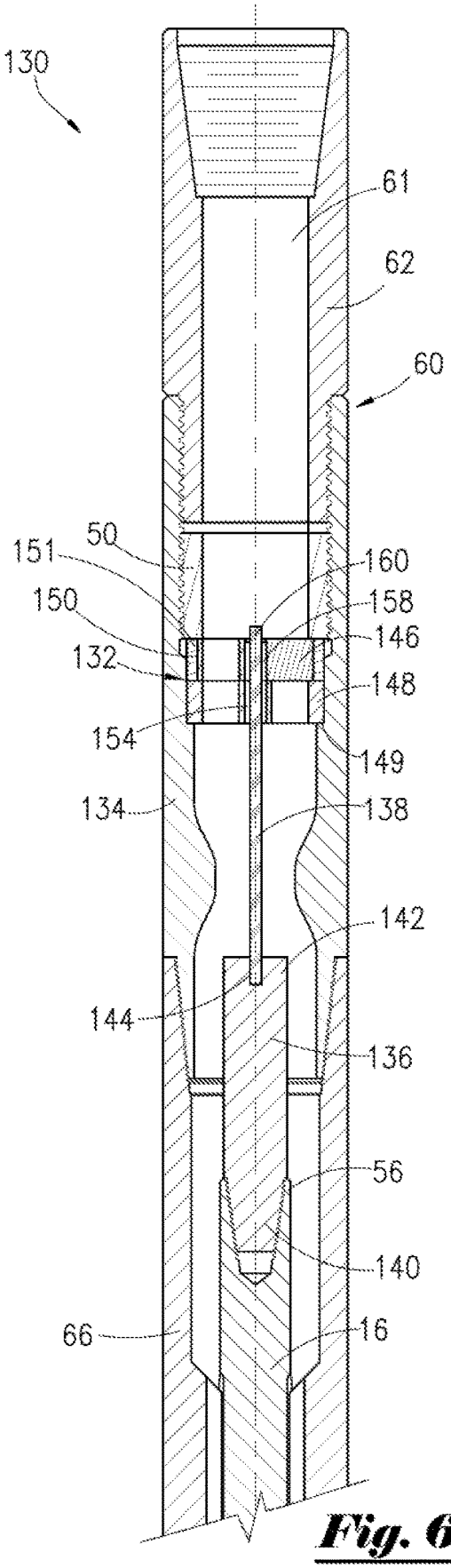
FIGS. 6A-6B are a cross-sectional view of an alternate embodiment of the vibration assembly.
Figure 6B:
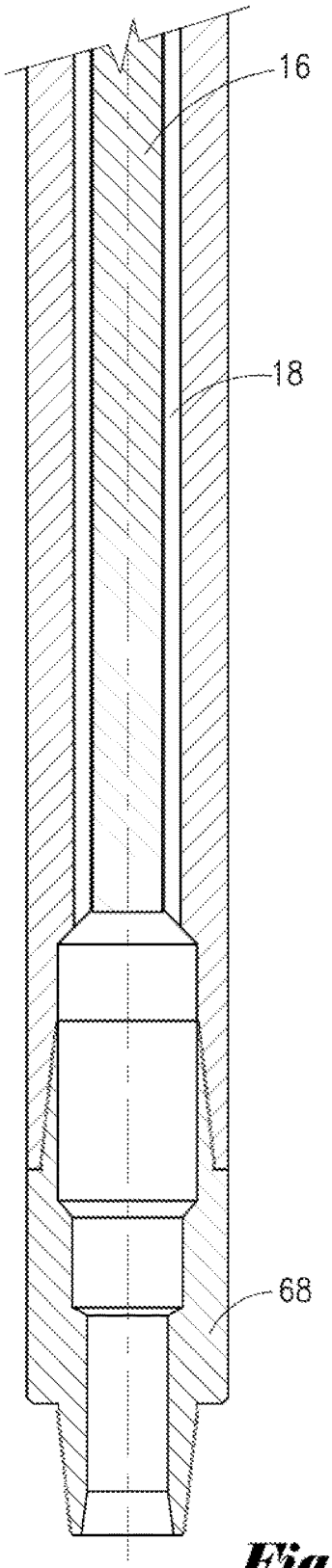

FIGS. 6A-6B illustrate another alternate embodiment of the vibration assembly of the present disclosure, with the same reference numbers indicating the same structure and function described above. Vibration assembly 130 includes valve 132 disposed above rotor 16 and stator 18 all disposed within inner bore 61 of housing 60, which includes housing segments 62, 134, 66, and 68. Vibration assembly 130 also includes adapter 136 and flex line 138 interconnecting valve 132 and rotor 16. Lower end 140 of adapter 136 is secured to upper end 56 of rotor 16, and upper end 142 of adapter 136 is secured to lower end 144 of flex line 138. Valve 132 may include rotating valve segment 146 and stationary valve segment 148. Stationary valve segment 148 may engage and be supported by inner shoulder 149 of housing segment 134. Rotating valve segment 146 may be positioned above stationary valve segment 148 and below nut 50, which is threadedly connected to a surface of the inner bore of housing segment 134. In this way, rotor 16 is suspended within inner bore 61 of housing 60 and within stator 18 by adapter 136, flex line 138, and rotating valve segment 146. Outer surface 150 of rotating valve segment 146 is radially guided by radial sleeve 151. An upper end of radial sleeve 151 abuts a lower end of nut 50, and a lower end of radial sleeve 151 abuts an upper end of stationary valve segment 148. Stationary valve segment 148 may be maintained in a non-rotating and stationary position by a compression force applied by nut 50 through radial sleeve 151.

Figure 8:
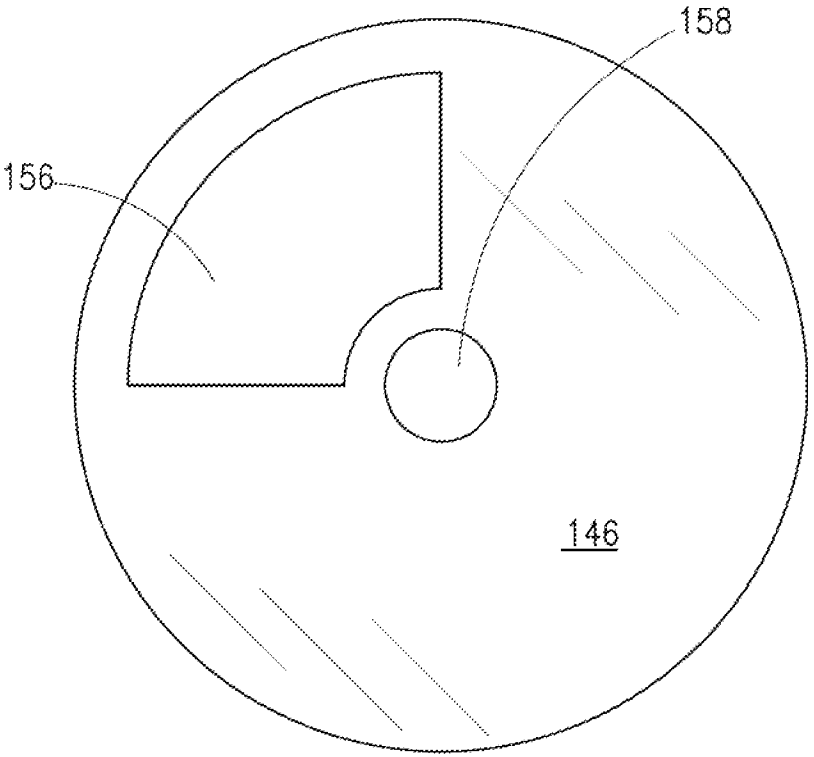
FIG. 8 is a top view of a rotating valve segment of the vibration assembly of FIGS. 6A-6B.
Figure 7:
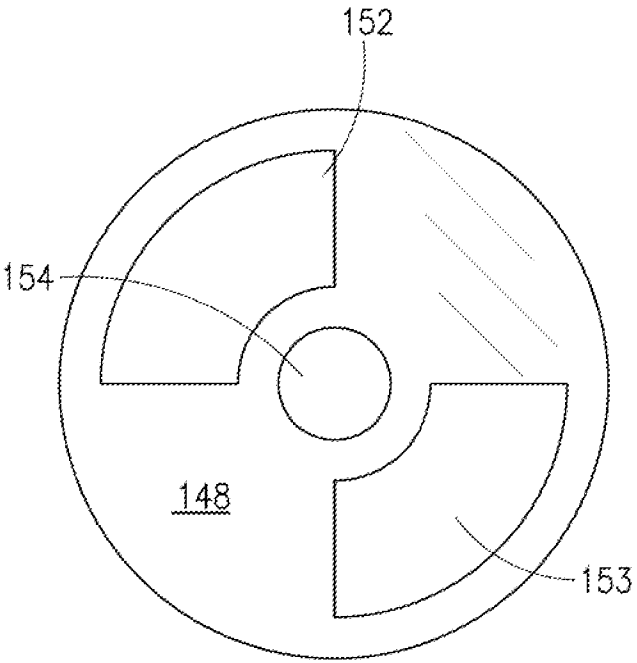
FIG. 7 is a top view of a stationary valve segment of the vibration assembly of FIGS. 6A-6B.

Referring now to FIGS. 7 and 8, stationary valve segment 148 may be formed of a plate or disc including fluid passages 152 and 153 and central aperture 154. Rotating valve segment 146 may be formed of a plate or disc including fluid passage 156 and central aperture 158. In an open position, passage 156 of rotating valve segment 146 is at least partially aligned with passage 152 or passage 153 of stationary valve segment 148 to allow a fluid to flow through valve 132. In a restricted position, passage 156 of rotating valve segment 146 is unaligned (at least partially) with passages 152, 153 of stationary valve segment 148.

With reference again to FIGS. 6A-6B, flex line 138 is disposed through central aperture 154 of stationary valve segment 148. Upper end 160 of flex line 138 is secured to central aperture 158 of rotating valve segment 146. Due to the pressure drop generated by rotor 16, flex line 138 is in tension and stationary valve segment 148 functions as a thrust bearing acting against rotating valve segment 146. Flex line 138 may be formed of a cable, rope, rod, chain, or any other structure having a stiffness sufficient to transmit torque between adapter 136 and rotating valve segment 146. For example, flex line 138 may be formed of a steel rope or cable. Flex line 138 may be secured to central aperture 158 by clamping, braising, wedging, with fixed bolts, or any other suitable means. Rotation of rotor 16 may rotate adapter 136, flex line 138, and rotating valve segment 146. The suspended arrangement of rotor 16 within inner bore 61 of housing 62 allows for the use of flex line 138 between shaft 16 and valve 132 (instead of a rigid flex shaft), which reduces the overall length and weight of vibration assembly 130 over conventional vibration tools.

Vibration assembly 130 may be secured within a drill string by threadedly connecting housing segment 62 to a first drill string segment and connecting housing segment 68 to a second drill string segment. A fluid may be pumped through an inner bore of the first drill string segment and into inner bore 61 of housing 60. With valve 132 in the open position, the fluid may flow through fluid passage 156 of rotating valve segment 146 and fluid passage 152 or 153 of stationary valve segment 148. The fluid flow may continue into inner bore 61 of housing 60 around flex line 138, around adapter 135, and around upper end 56 of rotor 16. As the fluid flow through stator 18 rotates rotor 16 (as described above), adapter 136, flex line 138, and rotating valve segment 146 are rotated as torque is transmitted to these elements. Rotating valve segment 146 rotates relative to stationary valve segment 148, which cycles valve 132 between the open position and the restricted position in which fluid flow through valve 132 is restricted. The fluid flow restriction generates a pressure pulse or waterhammer that is transmitted upstream to the drill string above vibration assembly 130. The repeated pressure pulse generation causes a stretching and retracting of the drill string initiating vibration in the drill string above vibration assembly 130, thereby facilitating and easing the movement of the drill string through a wellbore. The vibration may reduce friction between an outer surface of the drill string and an inner surface of the wellbore.

In one embodiment, vibration assembly 130 further includes a shock assembly, such as shock assembly 82. The shock assembly facilitates axial movement (in both directions) of the drill string above vibration assembly 130 relative to the drill string below vibration assembly 130.

In conventional vibration tools, a valve is positioned below a positive displacement power section. A pressure pulse generated in the valve of conventional vibration tools must be transmitted through the positive displacement power section before being transmitted to the drill string above. Because power sections are designed to convert hydraulic energy into mechanical energy, the positive displacement power sections of conventional vibration tools use a portion of the hydraulic energy of the pressure pulse generated by the valve below by converting an amount of the hydraulic energy into mechanical energy to overcome friction between the rotor and the stator, which is defined by the mechanical efficiency of the positive displacement power section itself. Additionally, the rubber or other flexible material of the stator in conventional vibration tools is compressed when in contact with the rotor, which dampens the magnitude of the pressure pulse as the pressure pulse is forced to travel through the positive displacement power section before being transmitted to the drill string above.

In the vibration assembly of the present disclosure, a valve is disposed above a power section. The pressure pulse generated by the valve is transmitted to the drill string above without traveling across the power section. In other words, the vibration assembly of the present disclosure transmits an unobstructed pressure pulse or waterhammer to the drill string or coiled tubing above. Accordingly, the vibration assembly of the present disclosure transmits the pressure pulse or waterhammer and vibration energy to the drill string above more efficiently than conventional vibration tools.

In a further embodiment, a wear resistant vibration assembly may be designed to prevent separation between a rotating valve segment and a non-rotating valve segment. In one embodiment, the wear resistant vibration assembly may include a lower thrust bearing at the lower end of the rotor. The lower thrust bearing may prevent axial movement of the rotor, flex shaft, and valve segments as portions of the thrust bearings are worn through use. In another embodiment, the wear resistant vibration assembly may include a non-rotating valve segment positioned above a rotating valve segment, with the non-rotating valve segment configured to move axially within a predetermined range without rotating (i.e., an axially sliding non-rotating valve segment). In yet another embodiment, the wear resistant vibration assembly includes both a lower thrust bearing and a non-rotating valve segment configured to move axially within a predetermined range without rotating.

Figures 9A, 9B, 9C:
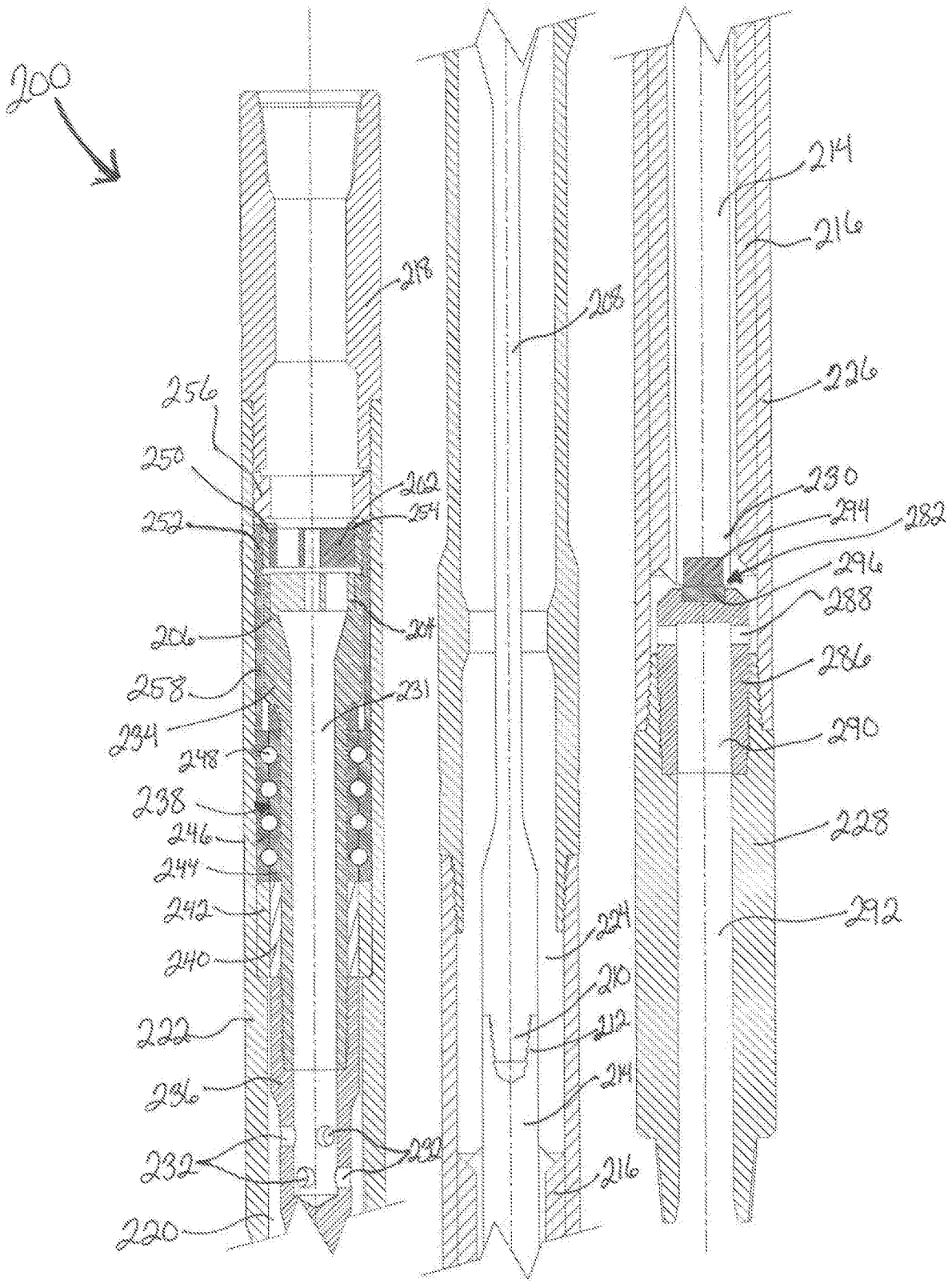
FIGS. 9A-9C are a cross-sectional view of a wear resistant vibration assembly.

FIGS. 9A-9C illustrate wear resistant vibration assembly 200. Except as otherwise described, the components of wear resistant vibration assembly 200 include the same features described above in connection with the corresponding components of vibration assembly 10. Vibration assembly 200 includes non-rotating valve segment 202 positioned above rotating valve segment 204. Rotating valve segment 204 may be rotationally secured to upper end 206 of mandrel 234. Mandrel 234 is connected to flex shaft 208 such that rotation of flex shaft 208 rotates mandrel 234 and rotating valve segment 204. Mandrel 234 and flex shaft 208 may be threadedly secured to one another. Lower end 210 of flex shaft 208 may be secured to upper end 212 of rotor 214, which may be at least partially disposed through stator 216.

Valve segments 202 and 204, mandrel 234, flex shaft 208, rotor 214, and stator 216 are each disposed within a central bore of a housing, which may be formed of housing segments. For example, housing segment 218 may be disposed above valve segments 202 and 204. Valve segments 202 and 204, mandrel 234, and flex shaft 208 may be disposed through central bore 220 of housing segment 222. Lower end 210 of flex shaft 208, rotor 214, and stator 216 may be disposed within central bore 224 of housing segment 226. Housing segment 228 may be disposed below lower end 230 of rotor 214. Adjacent housing segments may be threadedly secured to one another.

Central bore 231 of mandrel 234 extends from upper end 206 to central bore 233 of flex shaft 208, which extends to fluid passages 232 of flex shaft 208. Flex shaft 208 may include any number of fluid passages 232 to support fluid flow through central bores 231 and 233 of mandrel 234 and flex shaft 208, respectively. The upper portion 236 of flex shaft 208 surrounding central bore 233 is connected to lower end of mandrel 234. Thrust bearings 238 and radial bearings 240, 242 may be disposed around mandrel 234. Thrust bearings 238 may include inner races 244, outer races 246, and roller elements 248 disposed in partial cavities between inner and outer races 244 and 246. Radial bearings 240, 242 may abut an upper end of upper portion 236 of flex shaft 208. Below fluid passages 232, flex shaft 208 may be formed of a rod or bar of sufficient length to provide flexibility for offsetting the eccentric motion of a multi-lobe rotor.

Valve segments 202 and 204 may each be formed of a plate or disc including a central passage and one or more fluid passages. In an open position, a fluid passage of valve segment 202 is at least partially aligned with a fluid passage of valve segment 204 to allow a fluid to flow through the valve assembly. The fluid flow may be temporarily restricted when rotating valve segment 204 rotates such that the fluid passage of valve segment 204 is not aligned with the fluid passage of valve segment 202. In this closed position, a minimum amount of fluid may flow through the central apertures of valve segments 202 and 204 to drive rotor 214 in stator 216.

Figure 10:
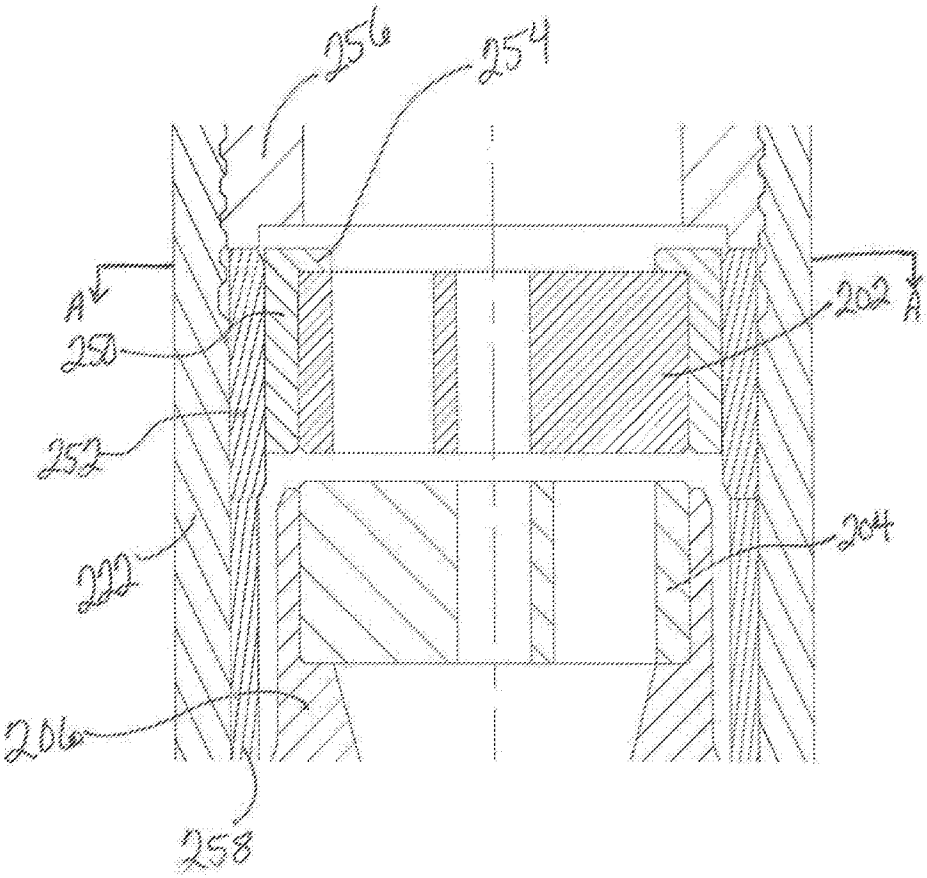
FIG. 10 is a detail cross-sectional view of the valve of the wear resistant vibration assembly in FIGS. 9A-9C.

Referring to FIGS. 9A and 10, non-rotating valve segment 202 may be disposed above rotating valve segment 204 and upper end 206 of mandrel 234. Inner sleeve 250 may be disposed around non-rotating valve 202, and outer sleeve 252 may be disposed around inner sleeve 250. Inner sleeve 250 may include upper shoulder 254 configured to retain non-rotating valve segment 202 (i.e., to prevent non-rotating valve segment 202 from traveling through the upper end of the bore in inner sleeve 250). Nut 256 may be secured above non-rotating valve segment 202 within housing segment 222. Nut 256 may be threadedly connected within housing segment 222 to secure outer sleeve 252, compression sleeve 258 disposed around upper end 206 of mandrel 234, thrust bearings 238, and radial bearings 242 in place within housing segment 222, as illustrated.

With reference now to FIG. 10, non-rotating valve segment 202 may be maintained in a non-rotating position by nut 50, outer sleeve 252, and inner sleeve 250. Fluid flowing through the central bore of nut 256 may exert a downstream force on shoulder 254 of inner sleeve 250 and non-rotating valve segment 202 such that non-rotating valve segment 202 remains in contact with rotating valve segment 204.

Figure 11:
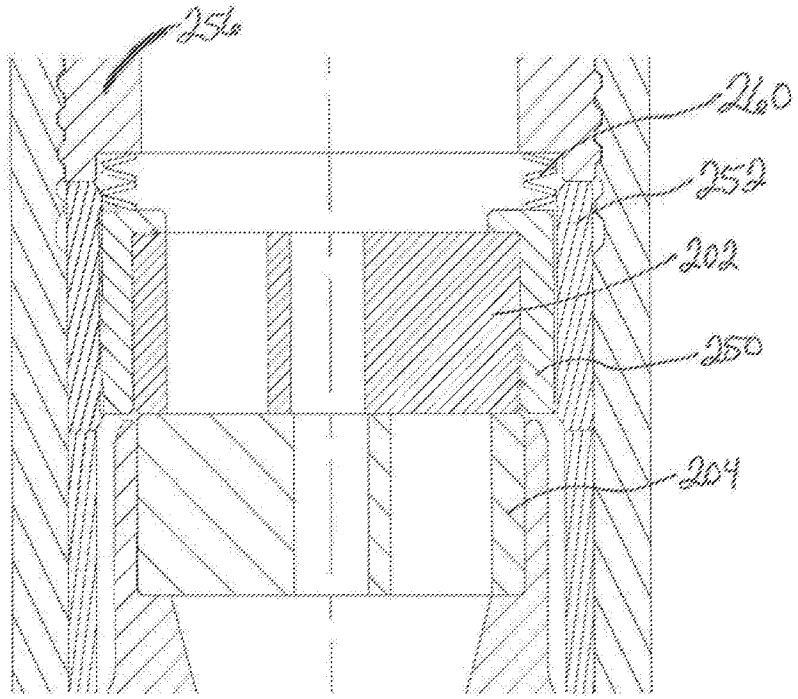
FIG. 11 is a detail cross-sectional view of an alternate valve of the wear resistant vibration assembly.
Figure 12:
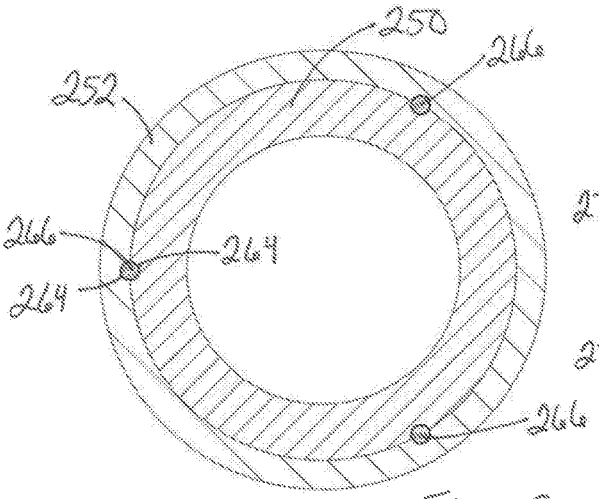
FIG. 12 is a cross-sectional view of an inner sleeve and an outer sleeve of the valve in the wear resistant vibration assembly taken along line A-A in FIG. 10.
Figure 13:
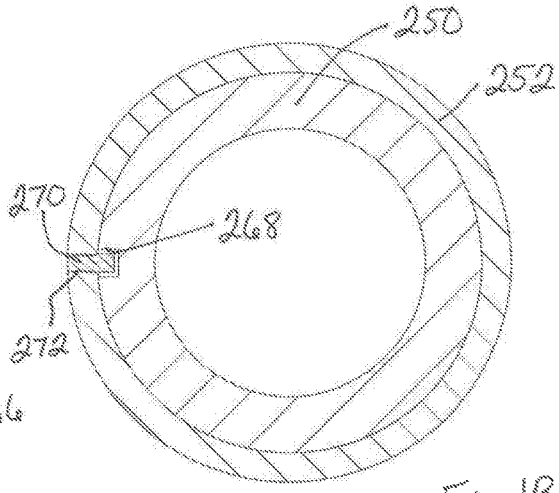
FIG. 13 is a cross-sectional view of an alternate inner sleeve and outer sleeve taken along line A-A in FIG. 10.
Figure 14:
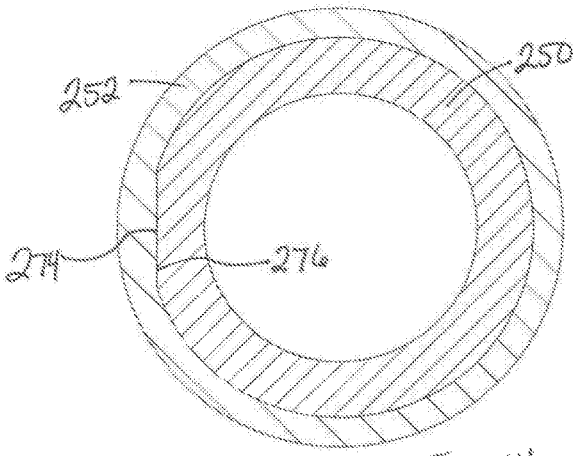
FIG. 14 is a cross-sectional view of a second alternate inner sleeve and outer sleeve taken along line A-A in FIG. 10.
Figure 15:
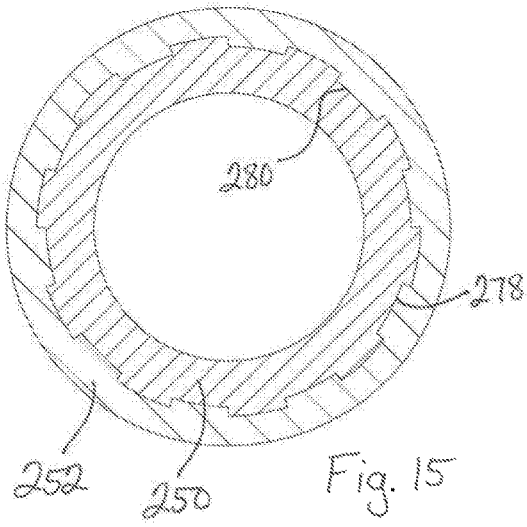
FIG. 15 is a cross-sectional view of a third alternate inner sleeve and outer sleeve taken along line A-A in FIG. 10.

As illustrated in FIG. 11, in one embodiment, wear resistant vibration assembly 200 further includes one or more springs 260 disposed between a lower end of nut 256 and an upper surface of inner sleeve 250. The one or more springs 260 bias inner sleeve 250 and non-rotating valve segment 202 in a downstream direction toward rotating valve segment 204. In both embodiments, vibration assembly 200 is configured to maintain contact between the two valve segments even if rotating valve segment 204 moves in a downstream direction within housing segment 222 due to wear of thrust bearings 238.

With reference to FIGS. 12-15, inner sleeve 250 and non-rotating valve segment 202 are configured to slide axially within outer sleeve 252 without rotation. Inner sleeve 250 and outer sleeve 252 each includes a cooperating alignment mechanism configured to allow relative axial sliding and to prevent relative rotation between inner sleeve 250 and outer sleeve 252. In the embodiment illustrated in FIG. 12, the cooperating alignment mechanism of inner sleeve 250 and outer sleeve 252 includes axial grooves 264 in inner sleeve 250 and outer sleeve 252. An elongated pin 266 is positioned within each set of the aligned axial grooves 264. Axial grooves 264 of inner sleeve 250 may slide along elongated pin 266 to allow inner sleeve 250 to move axially relative to outer sleeve 252 without relative rotation between the sleeves. In a second embodiment illustrated in FIG. 13, the cooperating alignment mechanism of inner sleeve 250 includes elongated recess 268, and the cooperating alignment mechanism of outer sleeve 252 includes pin 270 secured within aperture 272. Inner sleeve 250 may slide axially within outer sleeve 252, with pin 270 engaging elongated recess 268 to prevent relative rotation between inner sleeve 250 and outer sleeve 252. In a third embodiment illustrated in FIG. 14, the cooperating alignment mechanism of inner sleeve 250 includes flat outer surface 274, and the cooperating alignment mechanism of outer sleeve 252 includes reciprocal flat inner surface 276 configured to engage flat outer surface 274 of inner sleeve 250. Inner sleeve 250 may slide axially within outer sleeve 252 with flat surfaces 274, 276 preventing relative rotation between inner sleeve 250 and outer sleeve 252. In a fourth embodiment illustrated in FIG. 15, the cooperating alignment mechanism of inner sleeve 250 includes spline profile outer surface 278, and the cooperating alignment mechanism of outer sleeve 252 includes spline profile inner surface 280 that is reciprocal to and configured to engage spline profile outer surface 278 of inner sleeve 250. Inner sleeve 250 may slide axially within outer sleeve 252 with spline profile surfaces 278, 280 preventing relative rotation between inner sleeve 250 and outer sleeve 252.

With reference again to FIG. 9C, wear resistant vibration assembly 200 may also include lower thrust bearing 282 at lower end 230 of rotor 214. Lower thrust bearing 282 takes up an axial load to reduce wear of components within thrust bearings 238, thereby preventing axial movements of rotor 214, flex shaft 208, mandrel 234, and valve segment 204.

Lower thrust bearing 282 may be formed of a rotor bearing disposed above and in contact with a second bearing. The rotor bearing and the second bearing are each a thrust bearing. The rotor bearing may be housing within a cavity in lower end 230 of rotor 214. Alternatively, a lower surface of lower end 230 may form the rotor bearing. The second bearing may be housed within a cavity in an upper end of plug 286. Alternatively, an upper surface of plug 286 may form the second bearing.

Plug 286 may include an upper surface above fluid passages 288, which lead to central bore 290. Plug 286 is disposed below rotor 214 with the lower end of plug 286 secured within housing segment 228. Fluid passages 288 may be disposed above the upper end of housing segment 228. Plug 286 may include any number of fluid passages 288, such as between 1 and 10 fluid passages 288, or any subrange therein. In one embodiment, a diameter of central bore 290 of plug 286 is about equal to a diameter of central bore 292 of housing segment 228. A fluid exiting the cavities between rotor 214 and stator 216 may flow around the upper end of plug 286, flow through fluid passages 288, flow through central bore 290 of plug 286, and into central bore 292 of housing segment 228.

Figure 16:
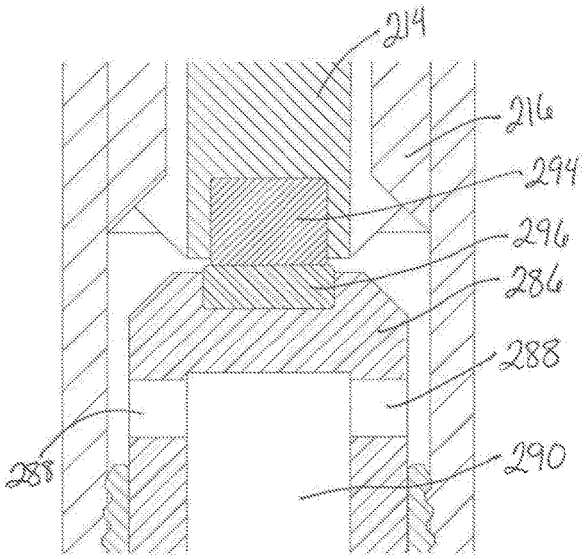
FIG. 16 is a detail cross-sectional view of a lower thrust bearing of the wear resistant vibration assembly.

In the embodiment illustrated in FIGS. 9C and 16, lower thrust bearing 282 includes rotor bearing 294 housed within a cavity in lower end 230 of rotor 214 and second bearing 296 housed within a cavity in the upper end of plug 286. Rotor bearing 294 and second bearing 296 may be formed of blocks formed of an abrasion resistant metal, tungsten carbide, silicon carbide, polycrystalline diamond compact (PDC), grit hot-pressed inserts (GHI), or natural diamond.

Figure 17:
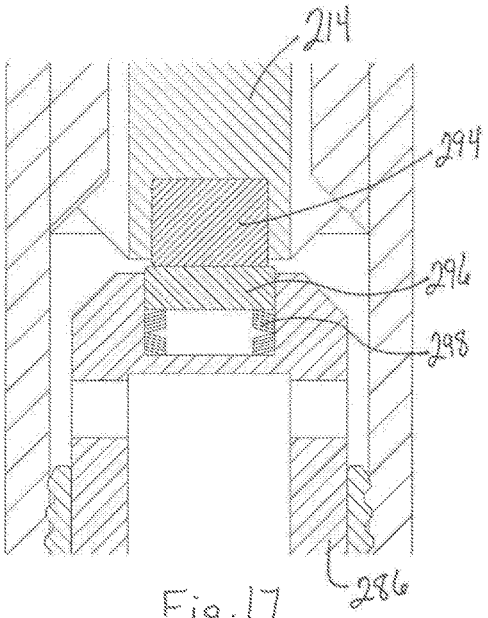
FIG. 17 is a detail cross-sectional view of an alternate lower thrust bearing.

FIG. 17 illustrates another embodiment of lower thrust bearing 282. Lower thrust bearing 282 may include rotor bearing 294 in a cavity in lower end 230 of rotor 214, second bearing 296 within a cavity in the upper end of plug 286, and spring 298 disposed below second bearing 296 in the cavity in the upper end of plug 286. In this embodiment, spring 298 biases second bearing 296 in a direction toward rotor bearing 294 to ensure continuous contact between second bearing 296 and rotor bearing 294. Spring 298 may be formed of a coil spring, coned-disc spring, conical spring washer, disc spring, Belleville spring, or cupped spring washer.

Alternatively, wear resistant vibration assembly 200 may include no plug 286 and lower thrust bearing 282 may include rotor bearing 294 in a cavity in lower end 230 of rotor 214 and second bearing 296 secured to housing segment 228 such that rotor bearing 294 and the second bearing 296 are in continuous contact. As readily understood by a skilled artisan, second bearing 296 may be secured to housing segment 228 in numerous ways (e.g., with bolts, pins, screws, brazed, welded, shrink-fit arrangement, or any other fastening device) and housing segment 228 may be modified to provide for fluid flow around second bearing 296 and into central bore 292 of housing segment 228.

In each embodiment, lower thrust bearing 282 prevents axial movement of rotor 214, flex shaft 208, mandrel 234, and valve segment 204 to prevent separation between valve segments 202 and 204.

In one alternate embodiment, wear resistant vibration assembly 200 includes an axially sliding non-rotating valve segment without lower thrust bearing 282. In another alternate embodiment, wear resistant vibration assembly 200 includes lower thrust bearing 282 in addition to an axially sliding non-rotating valve segment.

Wear resistant vibration assembly 200 may be secured within a drill string by threadedly connecting housing segment 218 to a first drill string segment and connecting housing segment 228 to a second drill string segment. A fluid may be pumped through an inner bore of the first drill string segment and into the inner bore of housing segment 218. With the valve in the open position, the fluid may flow through the fluid passages of non-rotating valve segment 202. The fluid flow may continue into inner bore 231 of mandrel 234 and inner bore 233 of flex shaft 208, through fluid passages 232 of flex shaft 208, into inner bore 220 of housing segment 222, around the lower portion of flex shaft 208, and around upper end 212 of rotor 214. The fluid flow through stator 216 rotates rotor 214, which causes flex shaft 208, mandrel 234, and rotating valve segment 204 to rotate as torque is transmitted to these elements. Rotating valve segment 204 rotates relative to non-rotating valve segment 202, which cycles the valve between the open position and the restricted position in which fluid flow through the valve is restricted. The fluid flow restriction generates a pressure pulse or waterhammer that is transmitted upstream to the drill string above wear resistant vibration assembly 200. The repeated pressure pulse generation causes a stretching and retracting of the drill string initiating vibration in the drill string above assembly 200, thereby facilitating and easing the movement of the drill string through a wellbore. The vibration may reduce friction between an outer surface of the drill string and an inner surface of the wellbore.

Lower thrust bearing 282 reduces the axial load taken up by thrust bearings 238. In this way, lower thrust bearing 282 reduces the wear on the components of thrust bearings 238. Additionally, as the components of thrust bearings 238 are worn through extended use, the configuration of inner sleeve 250 and outer sleeve 252 surrounding non-rotating valve segment 202 allows non-rotating valve segment 202 to maintain contact with rotating valve segment 204, thus continuing to create the pressure pulses as the fluid flow is temporarily restricted.

As used herein, "above" and any other indication of a greater height or latitude shall also mean upstream, and "below" and any other indication of a lesser height or latitude shall also mean downstream. As used herein, "drill string" shall include a series of drill string segments and a coiled tubing line.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A wear resistant vibration assembly for transmitting a pressure pulse in a drill string, comprising:

a positive displacement power section disposed in an inner bore of a housing, the positive displacement power section including a rotor disposed at least partially within a stator, wherein the rotor is configured to rotate within the stator upon a fluid flow through the positive displacement power section; and a valve disposed above the positive displacement power section within the inner bore of the housing, the valve including a rotating valve segment disposed below a non-rotating valve segment each including at least one fluid passage, wherein the valve further includes an inner sleeve disposed around the non-rotating valve segment and an outer sleeve disposed around the inner sleeve, wherein the outer sleeve is rotationally locked to the housing, wherein the inner sleeve and the outer sleeve each includes a cooperating alignment mechanism configured to allow relative axial sliding and to prevent relative rotation between the outer sleeve and the inner sleeve;

wherein the rotating valve segment is configured to rotate relative to the housing with a rotation of the rotor for cycling the valve between an open position and a restricted position, wherein in the open position the fluid passage of the rotating valve segment is aligned with the fluid passage of the non-rotating valve segment, wherein in the restricted position the fluid passage of the rotating valve segment is at least partially unaligned with the fluid passage of the non-rotating valve segment for restricting the fluid flow through the valve to generate and transmit an unobstructed pressure pulse through the drill string above the valve.

2. The wear resistant vibration assembly of claim 1, wherein the rotating valve segment and the non-rotating valve segment each includes a central passage, and wherein in the restricted position the fluid passage of the rotating valve segment is completely unaligned with the fluid passage of the non-rotating valve segment and the fluid flow travels through the central passages of the rotating valve segment and the non-rotating valve segment.

3. The wear resistant vibration assembly of claim 1, further comprising a nut threadedly secured to a surface of the inner bore of the housing, wherein the nut is disposed above the non-rotating valve segment and abuts an upper surface of the outer sleeve.

4. The wear resistant vibration assembly of claim 3, further comprising a spring disposed between a lower surface of the nut and an upper surface of the inner sleeve, wherein the spring biases the inner sleeve away from the nut and toward the rotating valve segment.

5. The wear resistant vibration assembly of claim 1, further comprising a mandrel and a flex shaft interconnecting the valve and the rotor, wherein the rotating valve segment is secured to an upper end of the mandrel, wherein an upper end of the rotor is secured to a lower end of the flex shaft, and wherein the flex shaft, the mandrel, and the rotating valve segment each rotates with the rotation of the rotor.

6. The wear resistant vibration assembly of claim 1, wherein the cooperating alignment mechanism of the outer sleeve is an axial groove in an inner surface of the outer sleeve, wherein the cooperating alignment mechanism of the inner sleeve is an axial groove in an outer surface of the inner sleeve, and wherein an elongated pin engages the axial grooves of the outer sleeve and the inner sleeve to allow axial sliding and to prevent relative rotation between the outer sleeve and the inner sleeve.

7. The wear resistant vibration assembly of claim 1, wherein the cooperating alignment mechanism of the outer sleeve is a pin secured within an aperture in the outer sleeve, wherein the cooperating alignment mechanism of the inner sleeve is an elongated recess configured to receive a distal end of the pin, and wherein the distal end of the pin engages and slides within the elongated recess of the inner sleeve to allow axial sliding and to prevent relative rotation between the outer sleeve and the inner sleeve.

8. The wear resistant vibration assembly of claim 1, wherein the cooperating alignment mechanism of the outer sleeve is a flat inner surface, wherein the cooperating alignment mechanism of the inner sleeve is a flat outer surface configured to engage the flat inner surface of the outer sleeve, and wherein the flat outer surface engages the flat inner surface to allow axial sliding and to prevent relative rotation between the outer sleeve and the inner sleeve.

9. The wear resistant vibration assembly of claim 1, wherein the cooperating alignment mechanism of the outer sleeve is a spline profile inner surface, wherein the cooperating alignment mechanism of the inner sleeve is a spline profile outer surface, and wherein the spline profile outer surface of the inner sleeve engages the spline profile inner surface of the outer sleeve to allow axial sliding and to prevent relative rotation between the outer sleeve and the inner sleeve.

10. The wear resistant vibration assembly of claim 1, further comprising a lower thrust bearing disposed at the lower end of the rotor, wherein the lower thrust bearing includes a rotor bearing disposed above and in contact with a second bearing.

11. The wear resistant vibration assembly of claim 10, further comprising a plug disposed within a cavity in the housing below a lower end of the rotor, the plug including one or more fluid passages extending from an outer surface to a central bore of the plug.

12. The wear resistant vibration assembly of claim 11, wherein the rotor bearing is a rotor block disposed in a cavity in the lower end of the rotor, wherein the second bearing is a plug block disposed in a cavity in the upper end of the plug, and wherein the rotor block engages the plug block as the rotor rotates within the housing.

13. The wear resistant vibration assembly of claim 12, further comprising a spring disposed in the cavity in the upper end of the plug, wherein the spring biases the plug block in a direction toward the rotor block.

14. A wear resistant vibration assembly for transmitting a pressure pulse in a drill string, comprising:

a positive displacement power section disposed in an inner bore of a housing, the positive displacement power section including a rotor disposed at least partially within a stator, wherein the rotor is configured to rotate within the stator upon a fluid flow through the positive displacement power section;

a lower thrust bearing disposed at the lower end of the rotor, wherein the lower thrust bearing includes a rotor bearing disposed above and in contact with a second bearing; and a valve disposed above the positive displacement power section within the inner bore of the housing, the valve including a rotating valve segment disposed below a non-rotating valve segment each including at least one fluid passage;

wherein the rotating valve segment is configured to rotate relative to the housing with a rotation of the rotor for cycling the valve between an open position and a restricted position, wherein in the open position the fluid passage of the rotating valve segment is aligned with the fluid passage of the non-rotating valve segment, wherein in the restricted position the fluid passage of the rotating valve segment is at least partially unaligned with the fluid passage of the non-rotating valve segment for restricting the fluid flow through the valve to generate and transmit an unobstructed pressure pulse through the drill string above the valve.

15. The wear resistant vibration assembly of claim 14, further comprising a plug disposed within a cavity in the housing below a lower end of the rotor, the plug including one or more fluid passages extending from an outer surface to a central bore of the plug; wherein the rotor bearing is a rotor block disposed in a cavity in the lower end of the rotor, wherein the second bearing is a plug block disposed in a cavity in the upper end of the plug, and wherein the rotor block engages the plug block as the rotor rotates within the housing.

16. The wear resistant vibration assembly of claim 15, further comprising a spring disposed in the cavity in the upper end of the plug, wherein the spring biases the plug block in a direction toward the rotor block.

17. The wear resistant vibration assembly of claim 14, wherein the valve further includes an inner sleeve disposed around the non-rotating valve segment and an outer sleeve disposed around the inner sleeve, wherein the outer sleeve is rotationally locked to the housing.

18. The wear resistant vibration assembly of claim 17, wherein the outer sleeve includes an axial groove in an inner surface, wherein the inner sleeve includes an axial groove in an outer surface, and wherein an elongated pin engages the axial grooves of the outer sleeve and the inner sleeve to allow axial sliding and to prevent relative rotation between the outer sleeve and the inner sleeve.

19. The wear resistant vibration assembly of claim 17, wherein the outer sleeve includes a pin secured within an aperture in the outer sleeve, wherein the inner sleeve includes an elongated recess configured to receive a distal end of the pin, and wherein the distal end of the pin engages and slides within the elongated recess of the inner sleeve to allow axial sliding and to prevent relative rotation between the outer sleeve and the inner sleeve.

20. The wear resistant vibration assembly of claim 17, wherein the outer sleeve includes a flat inner surface, wherein the inner sleeve includes a flat outer surface configured to engage the flat inner surface of the outer sleeve, and wherein the flat outer surface engages the flat inner surface to allow axial sliding and to prevent relative rotation between the outer sleeve and the inner sleeve.

21. The wear resistant vibration assembly of claim 17, wherein the outer sleeve includes a spline profile inner surface, wherein the inner sleeve includes a spline profile outer surface, and wherein the spline profile outer surface of the inner sleeve engages the spline profile inner surface of the outer sleeve to allow axial sliding and to prevent relative rotation between the outer sleeve and the inner sleeve.

* * * * *